US010468795B2

(12) United States Patent
Cheng et al.

(10) Patent No.: US 10,468,795 B2
(45) Date of Patent: Nov. 5, 2019

(54) ELECTRICAL CONNECTOR TRANSMITTING HIGH FREQUENCY SIGNALS

(71) Applicant: FOXCONN INTERCONNECT TECHNOLOGY LIMITED, Grand Cayman (KY)

(72) Inventors: Shan-Yong Cheng, New Taipei (TW); Tzu-Yao Hwang, New Taipei (TW); Ke-Hao Chen, New Taipei (TW); Kuo-Wei Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/145,229

(22) Filed: Sep. 28, 2018

(65) Prior Publication Data

US 2019/0097334 A1 Mar. 28, 2019

(30) Foreign Application Priority Data

Sep. 28, 2017 (CN) ..... 2017 1 0900283

(51) Int. Cl.

| | |
|---|---|
| ***H01R 12/70*** | (2011.01) |
| ***H01R 13/24*** | (2006.01) |
| ***H01R 13/432*** | (2006.01) |
| ***H01R 12/57*** | (2011.01) |
| ***H01R 13/41*** | (2006.01) |

(52) U.S. Cl.

CPC ..... *H01R 12/7076* (2013.01); *H01R 12/57* (2013.01); *H01R 13/2442* (2013.01); *H01R 13/41* (2013.01); *H01R 13/432* (2013.01)

(58) Field of Classification Search

CPC .... H01R 12/7076; H01R 12/57; H01R 12/58; H01R 13/2435; H01R 13/40; H01R 13/41; H01R 13/432; H01R 13/2442

USPC .... 439/66, 658, 626, 660, 6, 70, 74, 80, 82, 439/83, 84, 92

See application file for complete search history.

(56) References Cited

U.S. PATENT DOCUMENTS

| | | | | |
|---|---|---|---|---|
| 6,971,885 | B2 * | 12/2005 | Mowry | H01R 11/03 439/66 |
| 7,182,634 | B2 * | 2/2007 | Tran | H01R 13/2407 439/539 |
| 7,427,203 | B2 * | 9/2008 | Liao | H01R 12/57 439/66 |
| 7,559,811 | B1 * | 7/2009 | Polnyi | H01R 4/4809 439/591 |

(Continued)

*Primary Examiner* — Harshad C Patel

(74) *Attorney, Agent, or Firm* — Wei Te Chung; Ming Chieh Chang

(57) ABSTRACT

An electrical connector includes an insulative housing with a plurality of passageways and a plurality of contacts received therein. The housing includes opposite mating surface and mounting surface in the vertical direction. The contact includes an upstanding section retained in the passageway with a spring arm extending from an upper region of the upstanding plate and above the mating surface, and a mounting leg extending from a lower region of the upstanding plate around the mounting surface. The spring arm forms a contacting section around a free end thereof. One additional layer structure extends backwardly from a front end of the spring arm in a compressive folded manner and intimately abuts against the spring arm in the vertical direction.

20 Claims, 5 Drawing Sheets

(56) References Cited

U.S. PATENT DOCUMENTS

| | | | | |
|---|---|---|---|---|
| 8,500,458 | B2 * | 8/2013 | Chang | H01R 13/2435 439/66 |
| 2004/0266227 | A1 * | 12/2004 | Ma | H01R 9/096 439/71 |
| 2005/0054218 | A1 * | 3/2005 | Liao | H01R 9/096 439/66 |
| 2009/0263985 | A1 * | 10/2009 | Liu | H01R 13/2457 439/66 |
| 2009/0269950 | A1 * | 10/2009 | Liao | H01R 13/2435 439/66 |
| 2010/0029102 | A1 * | 2/2010 | Chen | H01R 13/17 439/66 |
| 2011/0111607 | A1 * | 5/2011 | Chang | H01R 12/58 439/70 |
| 2018/0375243 | A1 * | 12/2018 | Hsu | H01R 12/707 |
| 2019/0052021 | A1 * | 2/2019 | Hsu | H01R 13/6471 |

* cited by examiner

ELECTRICAL CONNECTOR TRANSMITTING HIGH FREQUENCY SIGNALS

BACKGROUND OF THE DISCLOSURE

1. Field of the Disclosure

The present disclosure relates to an electrical connector, and more particularly to an electrical connector transmitting high frequency signals.

2. Description of Related Arts

The electrical connector for use with the CPU (Central Processing Unit) essentially includes an insulative housing with a plurality of contacts mounted upon a printed circuit board via corresponding solder balls. To assure the required mechanical contact force between the CPU and the contact in a limited space, a cantilever arm of the contact is popularly used. Anyhow, such a cantilever arm results in relatively high impedance during the high frequency transmission.

An improved electrical connector is desired.

SUMMARY OF THE DISCLOSURE

Accordingly, an object of the present disclosure is to provide the contact used with an electrical connector with the required mechanical characters while lowering the negative effect due to high impedance and/or resonance.

To achieve the above object, an electrical connector includes an insulative housing with a plurality of passageways and a plurality of contacts received therein. The housing includes opposite mating surface and mounting surface in the vertical direction, and the passageways extend therethrough both the mating surface and the mounting surface. The contact includes an upstanding section retained in the passageway with a spring arm extending from an upper region of the upstanding plate and above the mating surface, and a mounting leg extending from a lower region of the upstanding plate around the mounting surface. The spring arm forms a contacting section around a free end thereof. One additional layer structure extends backwardly from a front end of the spring arm in a compressive folded manner and intimately abuts against the spring arm in the vertical direction. The additional layer structure is optimally located under the spring arm and between the spring arm and the top surface of the housing.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
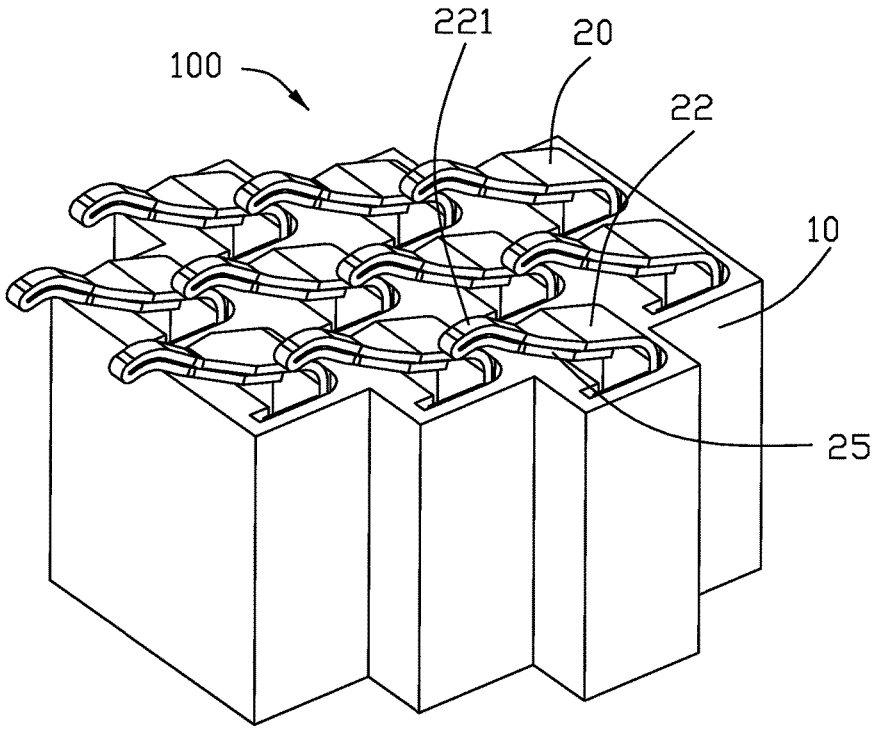
FIG. 1 is a perspective view of the electrical connector according to a first embodiment of the invention.

Reference will now be made in detail to the embodiments of the present disclosure. An electrical connector 100 for connecting a CPU (Central Processing Unit) (not shown) to a printed circuit board (not shown), including an insulative housing 10 with a plurality of passageways 11 therein and a plurality of contacts 20 respectively received within the corresponding passageways 11. The housing forms opposite top and bottom surfaces 101, 102 in the vertical direction. The passageways 11 extend through both the top surface 101 and the bottom surface 102. Each passageway 11 further includes a retention slot 111.

The contact 20 includes an upstanding plate 21 retained in the corresponding passageway 11, a spring arm 22 extending from an upper end of the upstanding plate 21 above the top surface 101, and a mounting leg 23 extending from a lower end of the upstanding plate 21 around the bottom surface 102. The spring arm 22 forms an upward bulged contacting section 221 which directly contacts upwardly the corresponding conductive pad of the CPU (not shown) in this embodiment. An additional layer structure 25 is intimately attached under a bottom surface of the spring arm 22 so as to be located between the spring arm 22 and the top surface 101 in the vertical direction. Opposite, if the additional layer structure is attached on the upper surface of the spring arm 22, the contacting section 221 will be indirectly upwardly contact the corresponding conductive pad of the CPU (not shown) via the additional layer structure. In this embodiment, the additional layer structure 25 unitarily backwardly extends from a front end of the spring arm 22. Understandably, if the spring arm 22 forms a straight edge rather than the deflected edge, the additional layer structure 25 may be bent from the side edge of the spring arm 22.

The upstanding plate 21 includes a first retention section 211 and a second retention section 212 which is retained in the retentions slot 111. In this embodiment, the spring arm 22 extends from the upper edge of the first retention section 211 while the mounting leg 23 extends from a lower edge of the second retention section 212. In this embodiment, the mounting leg 23 is slightly higher than the bottom surface 102 so as to have the corresponding solder ball (not shown), which is attached on an undersurface of the mounting leg 23, somewhat retained by the passageway 11.

Figure 2:
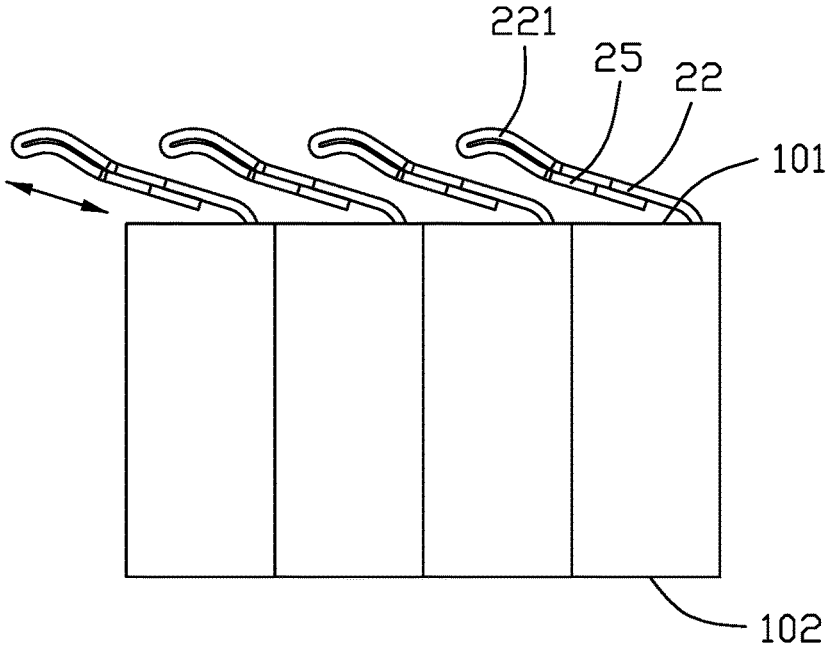
FIG. 2 is a side view of the electrical connector of FIG. 1.
Figure 3:
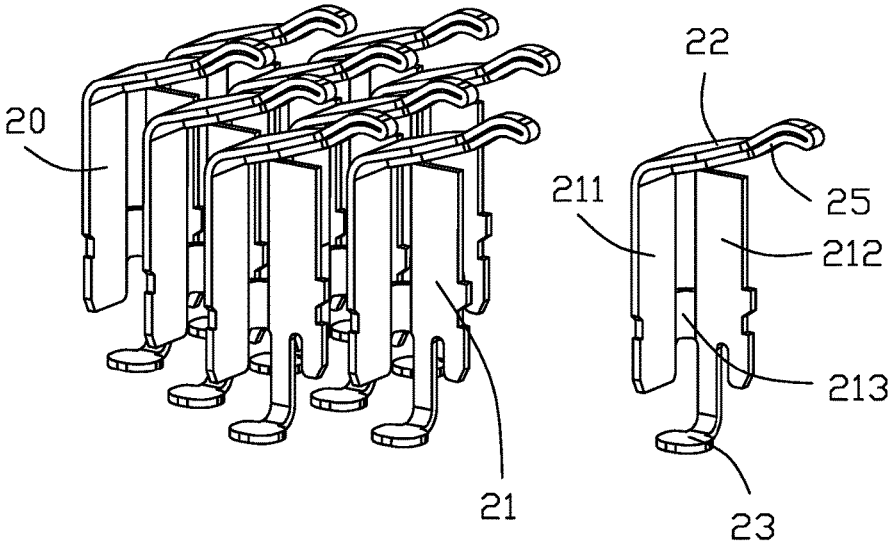
FIG. 3 is an exploded perspective view of the electrical connector of FIG. 1.
Figure 3:
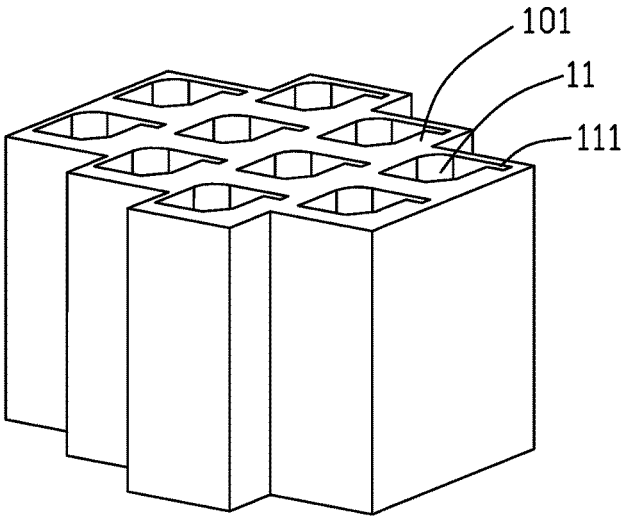
Figure 4:
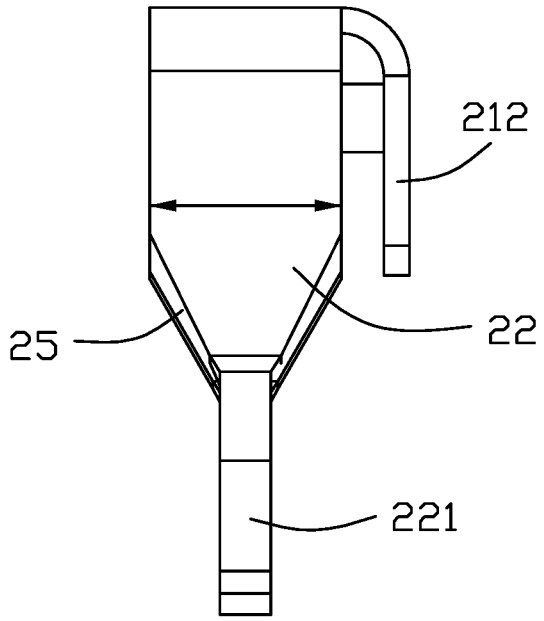
FIG. 4 is a top view of the contact of the electrical connector of FIG. 1.
Figure 5:
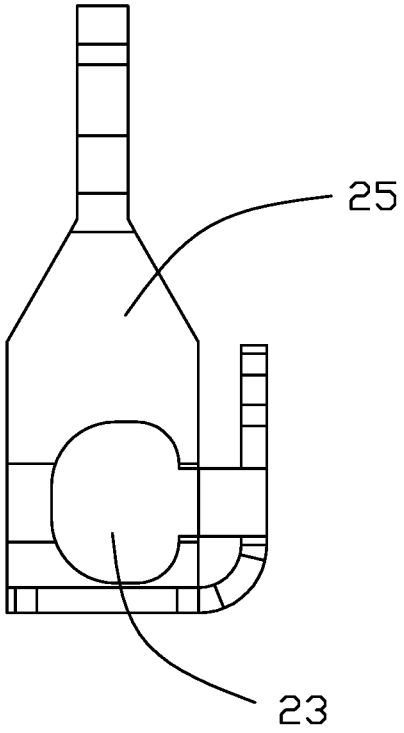
FIG. 5 is a bottom view of the contact of the electrical connector of FIG. 1.

The spring arm 22 defines a width direction as shown in the double-arrow in FIG. 4, and a extension direction as shown in the double-arrow in FIG. 2. As shown in FIG. 4, the width is decreased from the root/rear to the free/front end. As shown in FIG. 5, the additional layer structure 25 roughly covers the whole spring arm 22. The width of the additional layer structure 25 can be same with or slightly smaller than that of the spring arm 22.

The additional layer structure 25 not only reinforces the mechanical strength of the spring arm for bearing the downward pressing force from the CPU (not shown) but also lower the impedance around the spring arm which is exposed outside of the top surface 101 so as to avoid resonation during high frequency transmission.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including opposite top and bottom surfaces in a vertical direction;

a plurality of passageways formed in the housing and extending through both the top surface and the bottom surface; and a plurality of contacts disposed in the corresponding passageways, respectively, each of said contacts including an upstanding plate to retain the contact in the passageway, a spring arm extending upwardly and obliquely from an upper region of the upstanding plate above the top surface with an upwardly bulged contacting section thereof, and a mounting leg extending from a lower region of the upstanding plate around the bottom surface; wherein an additional layer structure unitarily extends backwardly from a front end of the spring arm and is intimately attached upon the spring arm in the vertical direction so as to not only reinforce strength of the spring arm mechanically but also lower impedance thereof electrically.

2. The electrical connector as claimed in claim 1, wherein the additional layer structure is positioned under the spring arm in the vertical direction.

3. The electrical connector as claimed in claim 1, wherein the spring arm defines a width direction and an extension direction mutually perpendicular to each other and commonly perpendicular to the vertical direction.

4. The electrical connector as claimed in claim 3, wherein the additional layer structure is dimensioned similar to the spring arm in the width direction.

5. The electrical connector as claimed in claim 4, wherein the additional layer structure is dimensions slightly smaller than the spring arm in the extension direction.

6. The electrical connector as claimed in claim 3, wherein the mounting leg extends from the lower region of the upstanding plate in the width direction.

7. The electrical connector as claimed in claim 3, wherein the contact section is dimensioned smaller than other portion of the spring arm in the width direction.

8. An electrical connector comprising:

an insulative housing including opposite top and bottom surfaces in a vertical direction;

a plurality of passageways formed in the housing and extending through both the top surface and the bottom surface; and a plurality of contacts disposed in the corresponding passageways, respectively, each of said contacts including an upstanding plate to retain the contact in the passageway, a spring arm extending upwardly and obliquely from an upper region of the upstanding plate above the top surface with an upwardly bulged contacting section thereof, and a mounting leg extending from a lower region of the upstanding plate around the bottom surface; wherein an additional layer structure unitarily extends from the spring arm in a compressively folded manner and is intimately positioned on the spring arm in the vertical direction so as to not only reinforce strength of the spring arm mechanically but also lower impedance thereof electrically.

9. The electrical connector as claimed in claim 8, wherein the additional layer structure is positioned under the spring arm in the vertical direction.

10. The electrical connector as claimed in claim 8, wherein the spring arm defines a width direction and an extension direction mutually perpendicular to each other and commonly perpendicular to the vertical direction.

11. The electrical connector as claimed in claim 10, wherein the additional layer structure is dimensioned similar to the spring arm in the width direction.

12. The electrical connector as claimed in claim 11, wherein the additional layer structure is dimensions slightly smaller than the spring arm in the extension direction.

13. The electrical connector as claimed in claim 10, wherein the mounting leg extends from the lower region of the upstanding plate in the width direction.

14. The electrical connector as claimed in claim 10, wherein the contact section is dimensioned smaller than other portion of the spring arm in the width direction.

15. An electrical connector comprising:

an insulative housing including opposite top and bottom surfaces in a vertical direction;

a plurality of passageways formed in the housing and extending through both the top surface and the bottom surface; and a plurality of contacts disposed in the corresponding passageways, respectively, each of said contacts including an upstanding plate to retain the contact in the passageway, a spring arm extending upwardly and obliquely from the upstanding plate above the top surface with an upwardly bulged contacting section thereof, and a mounting leg extending from a lower region of the upstanding plate around the bottom surface; wherein an additional layer structure unitarily extends backwardly from a front end of the spring arm in a compressively folded manner and is intimately positioned upon the spring arm in the vertical direction so as to not only reinforce strength of the spring arm mechanically but also lower impedance thereof electrically.

16. The electrical connector as claimed in claim 15, wherein the additional layer structure is positioned under the spring arm in the vertical direction.

17. The electrical connector as claimed in claim 15, wherein the spring arm defines a width direction and an extension direction mutually perpendicular to each other and commonly perpendicular to the vertical direction.

18. The electrical connector as claimed in claim 17, wherein the additional layer structure is dimensioned similar to the spring arm in the width direction.

19. The electrical connector as claimed in claim 18, wherein the additional layer structure is dimensions slightly smaller than the spring arm in the extension direction.

20. The electrical connector as claimed in claim 17, wherein the mounting leg extends from the lower region of the upstanding plate in the width direction.

* * * * *